US012687111B2

(12) United States Patent
Bloom et al.

(10) Patent No.: US 12,687,111 B2
(45) Date of Patent: Jul. 21, 2026

(54) BLOCK FOR HOLDING A CUTTING BIT

(71) Applicant: KENNAMETAL INC., Latrobe, PA (US)

(72) Inventors: Robbie Bloom, Hooversville, PA (US); Glenn Fowler, Carrolltown, PA (US); Brandon Kenno, Windber, PA (US)

(73) Assignee: KENNAMETAL INC., Latrobe, PA (US)

( * ) Notice: Subject to any disclaimer, the term of this patent is extended or adjusted under 35 U.S.C. 154(b) by 270 days.

(21) Appl. No.: 18/492,386

(22) Filed: Oct. 23, 2023

(65) Prior Publication Data

US 2025/0129720 A1 Apr. 24, 2025

(51) Int. Cl.
*E21C 35/197* (2006.01)
*E21C 35/18* (2006.01)

(52) U.S. Cl.
CPC ..... *E21C 35/197* (2013.01); *E21C 35/188* (2020.05)

(58) Field of Classification Search
CPC ..... E21C 35/197; E21C 35/188
See application file for complete search history.

(56) References Cited

U.S. PATENT DOCUMENTS 4,944,560 A 7/1990 Osterwise
8,740,314 B2 6/2014 O'Neill
8,911,024 B2 * 12/2014 Fundakowski ..... E01C 23/088 299/79.1
10,982,397 B2 * 4/2021 Hirman ..... E01C 23/088
2003/0184145 A1 * 10/2003 Carson, Jr. ..... E21C 35/19 299/79.1
2004/0145232 A1 7/2004 Sansone et al.
2006/0255649 A1 * 11/2006 Dawood ..... E21C 35/18 299/87.1
2011/0109147 A1 5/2011 Monyak et al.
2011/0204701 A1 8/2011 Monyak et al.
2012/0175939 A1 * 7/2012 O'Neill ..... E21C 35/187 299/81.3
2014/0035346 A1 2/2014 Fundakowski et al.
2016/0015620 A1 1/2016 Mailland
2016/0024920 A1 1/2016 Hall et al.
2016/0102549 A1 * 4/2016 Defibaugh ..... E21C 35/18 299/53
2016/0102550 A1 4/2016 Paros et al.
2016/0215620 A1 7/2016 Arnold et al.
2016/0341040 A1 * 11/2016 Weber ..... E21C 35/187

OTHER PUBLICATIONS

Kennametal., "NS300 Holder System," 12 pages, https://youtu.be/agLNOmOKi9Y?si=gMxa7CzyvlwVFS7q.

* cited by examiner

*Primary Examiner* — Janine M Kreck
(74) *Attorney, Agent, or Firm* — Christopher J. Owens

(57) ABSTRACT

A cutting-bit holder block may include a forward mounting portion, an interior portion, a bottom mounting portion, a side portion, and a cavity. The forward mounting portion may define an aperture sized to hold a cutting-bit. The interior portion may be disposed within the cutting-bit holder block. The aperture may extend from the forward mounting portion to the interior portion. The side portion may extend from the forward mounting portion to the bottom mounting portion. The cavity may be disposed in the side portion. The cavity may extend from the interior portion to the bottom mounting portion. The cavity may be in communication with the aperture.

10 Claims, 5 Drawing Sheets

BLOCK FOR HOLDING A CUTTING BIT

FIELD OF THE DISCLOSURE

The disclosure relates to blocks for holding a cutting-bit. The blocks may be used in earth cutting, mining, or other cutting applications.

BACKGROUND

A cutting-bit holder block may be used in a conventional cutting-bit holder block system to hold a cutting-bit in order to cut workpieces. The cutting-bit holder block may be attached to a rotatable cutting drum and a cutting-bit may be attached to the cutting-bit holder block. The rotatable cutting drum may be rotated to cut the workpiece with the cutting-bit held by the cutting-bit holder block. The cutting-bit holder block may have limited access for insertion of a tool to remove the cutting-bit from the cutting-bit holder block. Moreover, it may be difficult to remove broken portions of the cutting-bit from the cutting-bit holder block. Additionally, it may be difficult to attach the cutting-bit holder block to a vane of the rotatable cutting drum.

An improved cutting-bit holder block and method of use is needed to reduce or eliminate one or more issues associated with one or more of the conventional cutting-bit holder block systems.

SUMMARY

In one embodiment, a cutting-bit holder block may include a forward mounting portion, an interior portion, a bottom mounting portion, a side portion, and a cavity. The forward mounting portion may define an aperture sized to hold a cutting-bit. The interior portion may be disposed within the cutting-bit holder block. The aperture may extend from the forward mounting portion to the interior portion. The side portion may extend from the forward mounting portion to the bottom mounting portion. The cavity may be disposed in the side portion. The cavity may extend from the interior portion to the bottom mounting portion. The cavity may be in communication with the aperture.

In another embodiment, a cutting-bit holder block may include a forward mounting portion, an interior portion, a bottom mounting portion, a side portion, and an axis. The forward mounting portion may define an aperture sized to hold a cutting-bit. The interior portion may be disposed within the cutting-bit holder block. The aperture may extend from the forward mounting portion to the interior portion. The side portion may extend from the forward mounting portion to the bottom mounting portion. The axis may extend longitudinally through a center of the aperture. The axis may be disposed non-parallel to the side portion.

In still another embodiment, a method of use may be provided. In one step, a cutting-bit holder block may be attached to a vane of a rotatable cutting drum so that a side portion of the cutting-bit holder block is disposed against and/or parallel to a side-wall of the rotatable cutting drum. In another step, a cutting-bit may be attached to an aperture of the cutting-bit holder. An axis extending longitudinally through a center of the aperture may be disposed non-parallel to the side portion of the cutting-bit holder block.

The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
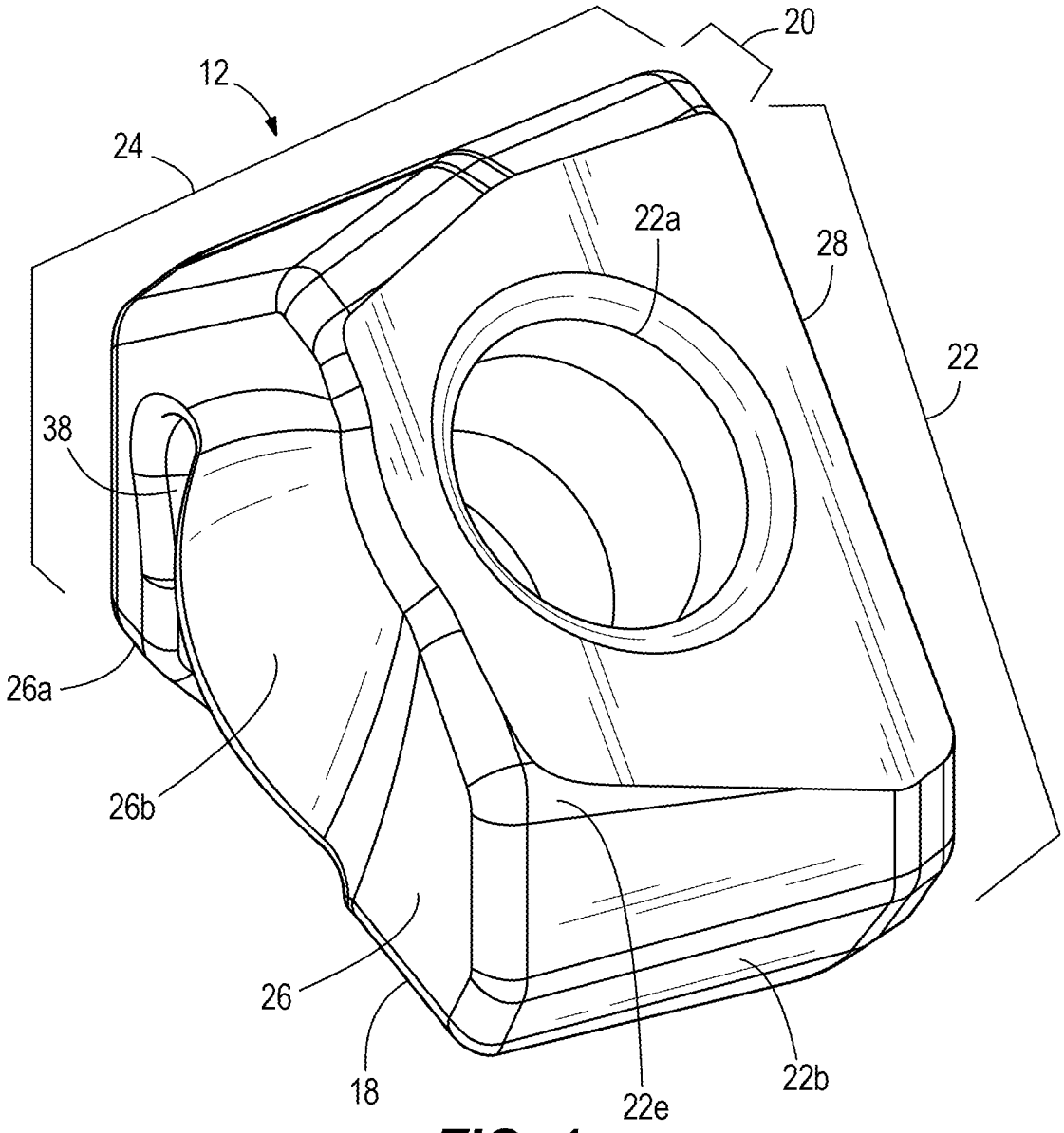
FIG. 1 illustrates a top perspective view of one embodiment of a cutting-bit holder block.
Figure 2:
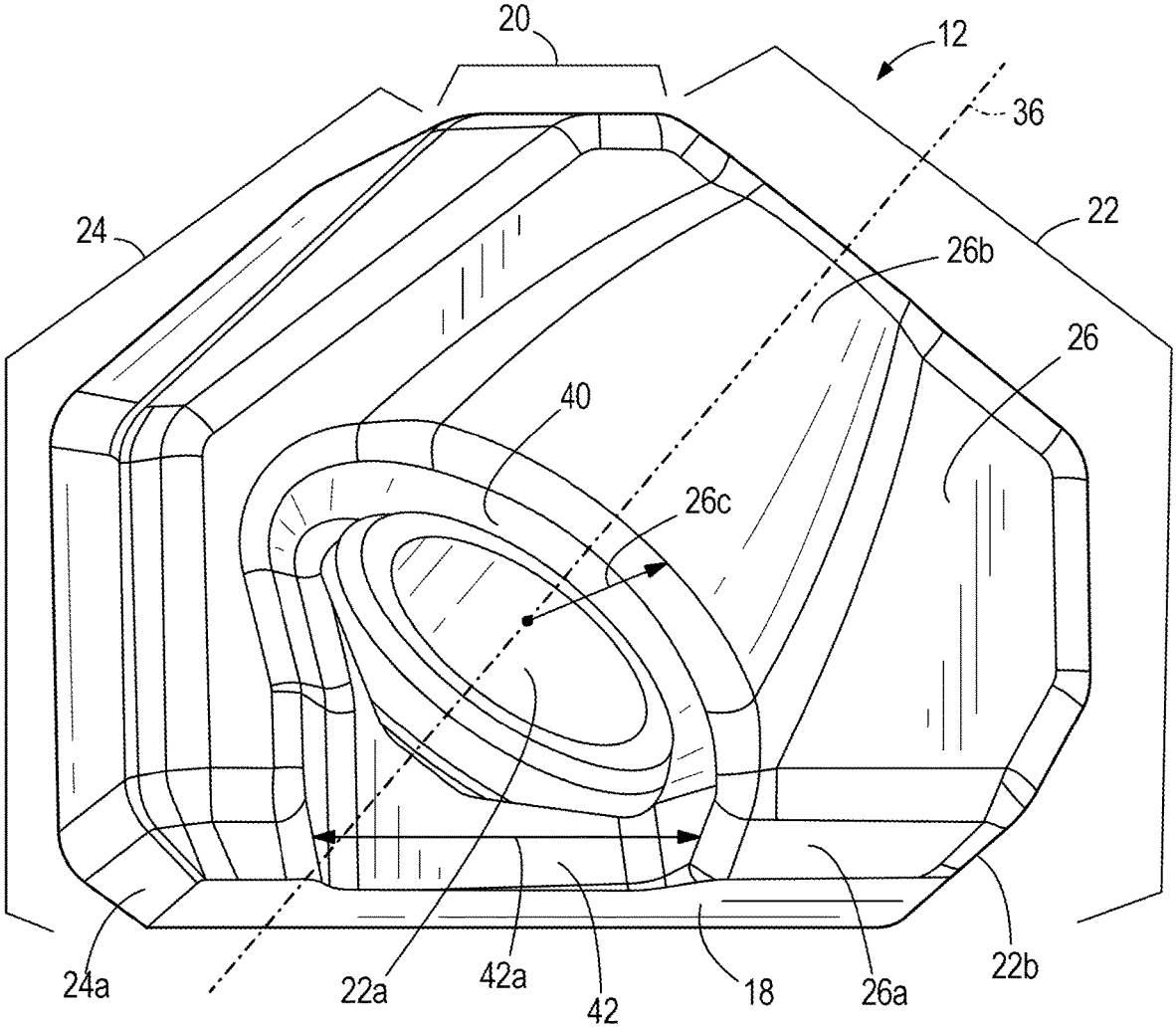
FIG. 2 illustrates a bottom perspective view of the cutting-bit holder block of FIG. 1.
Figure 3:
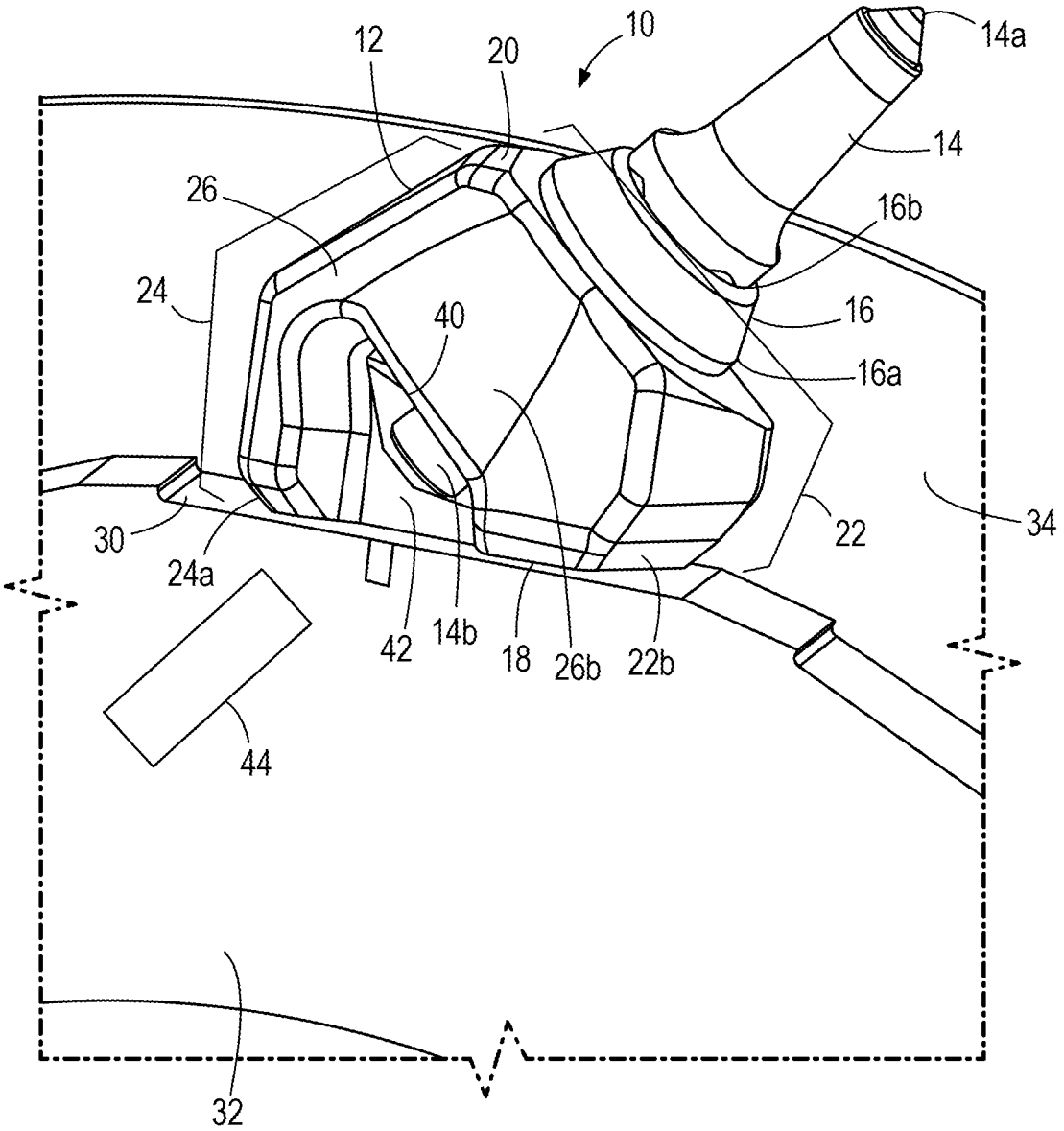
FIG. 3 illustrates a side perspective view of the cutting-bit holder block of FIG. 1 attached to a rotatable cutting drum and to a cutting-bit.
Figure 4:
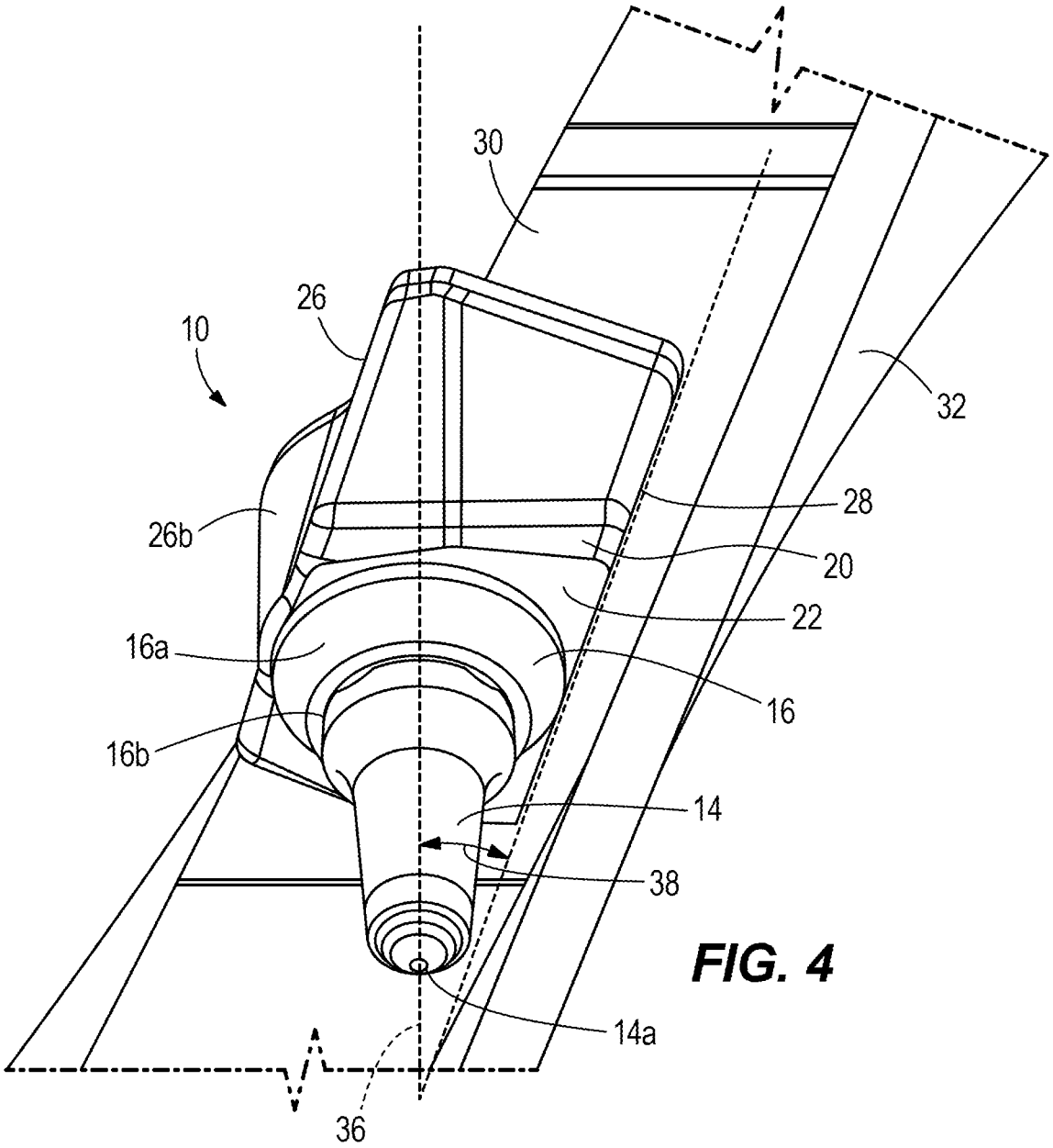
FIG. 4 illustrates a top perspective view of the cutting-bit holder block of FIG. 1 attached to a rotatable cutting drum and to a cutting-bit.

Before one embodiment of the disclosure is explained in detail, it is to be understood that the disclosure is not limited in its application to the details of the construction and the arrangements of components set forth in the following description or illustrated in the drawings. The present disclosure is capable of other embodiments and of being practiced or being carried out in various ways. Also, it is to be understood that the phraseology and terminology used herein is for the purpose of description and should not be regarded as limiting. The use of "including," "comprising," or "having" and variations thereof as used herein is meant to encompass the items listed thereafter and equivalents thereof as well as additional items. The use of "consisting of" and variations thereof as used herein is meant to encompass only the items listed thereafter and equivalents thereof. Further, it is to be understood that such terms as "forward", "rearward", "side", "top", and "bottom", etc., are words of convenience and are not to be construed as limiting terms. Unless specified or limited otherwise, the terms "attached", "secured" and variations thereof are used broadly and encompass both direct and indirect mountings, connections, supports, and couplings.

As illustrated in FIGS. 1-4 collectively, in one embodiment a cutting-bit holder block system 10 may comprise a cutting-bit holder block 12, a cutting-bit 14, and a sleeve 16. In other embodiments, the cutting-bit holder block system 10 may vary.

The cutting-bit holder block 12 may comprise a bottom mounting portion 18, a top portion 20, a forward mounting portion 22, a rearward portion 24, and side portions 26 and 28. The bottom mounting portion 18 may comprise one planar surface. The bottom mounting portion 18 is attached to a vane 30 of a rotatable cutting drum 32. The bottom mounting portion 18 may be welded to the vane 30 of the rotatable cutting drum 32. In other embodiments, the bottom mounting portion 18 may be attached to a pedestal (not shown) attached to the vane 30 of the rotatable cutting drum 32. The side portion 28 may be disposed against a side-wall 34 of the rotatable cutting drum 32. The side portion 28 may be parallel to the side-wall 34. An axis 36 extends longitudinally through a center of an aperture 22*a* in the forward mounting portion 22. The axis 36 is disposed non-parallel to side portions 26 and 28. An angle 38 extends between the axis 36 and the side portion 28. The angle 38 may be 20°. In other embodiments, the angle 38 may be in a range of 18°-22°. In still other embodiments, the angle 38 may further vary.

The top portion 20 may comprise a plurality of non-parallel surfaces. Side portions 26 and 28 may be opposed to one another. Side portion 26 may comprise a plurality of non-parallel surfaces. The side portion 26 may extend from the bottom mounting portion 18 to the forward mounting portion 22. The side portion 26 may also extend from the bottom mounting portion 18 to the top portion 20. The side portion 26 may further extend from the bottom mounting portion 18 to the rearward portion 24. The side portion 26 may have a beveled surface 26*a* which extends to the bottom mounting portion 18.

Side portion 28 may comprise a plurality of non-parallel surfaces. Similarly, the side portion 28 may extend from the bottom mounting portion 18 to the forward mounting portion 22. The side portion 28 may also extend from the bottom mounting portion 18 to the top portion 20. The side portion 28 may further extend from the bottom mounting portion 18 to the rearward portion 24. The side portion 28 may have a beveled surface (hidden) which extends to the bottom mounting portion 18.

The forward mounting portion 22 may comprise a plurality of non-parallel surfaces. The forward mounting portion 22 may be disposed to and between the bottom mounting portion 18 and the top portion 20. A bottom 22*b* of the forward mounting portion 22 may be beveled to the bottom mounting portion 18. The forward mounting portion 22 may define the aperture 22*a* sized to hold the cutting-bit 14 and the sleeve 16. In another embodiment, the aperture 22*a* may be sized to hold the cutting-bit 14 without the use of the sleeve 16.

The rearward portion 24 may comprise a plurality of non-parallel surfaces. The rearward portion 24 may be disposed to and between the bottom mounting portion 18 and the top portion 20. A bottom 24*a* of the rearward portion 24 may be beveled to the bottom mounting portion 18.

The aperture 22*a* may extend from the forward mounting portion 22 to an interior portion 40 of the cutting-bit holder block 12. A cavity 42 may be disposed in the side portion 26. The cavity 42 may extend from the interior portion 40 within the cutting-bit holder block 12 to the bottom mounting portion 18 of the cutting-bit holder block 12. The cavity 42 may be disposed between the rearward portion 24 and the interior portion 40. The cavity 42 may extend from the side portion 26 towards the side portion 28 without extending through the side portion 28. The cavity 42 may be in communication with the aperture 22*a*. The side portion 26 may comprise a portion of a barrel 26*b* extending from the interior portion 40 to the forward mounting portion 22. The barrel 26*b* comprises a radius 26*c*. The cavity 42 is wider 42*a* than twice the radius 26*c* of the barrel 26*b*.

The sleeve 16 may be disposed partially in the aperture 22*a* of the forward mounting portion 22. The sleeve 16 may be press-fit in the aperture 22*a*. A head 16*a* of the sleeve 16 may be disposed against the forward mounting portion 22, and a shaft (hidden) of the sleeve 16 may be disposed in the aperture 22*a*. The cutting-bit 14 may be disposed in an aperture 16*b* of the sleeve 16. The cutting-bit 14 may be press-fit in the aperture 16*b* of the sleeve 16. A tip 14*a* of the cutting bit 14 may extend above the sleeve 16. A shaft 14*b* of the cutting bit 14 may extend through the aperture 16*b* of the sleeve 16, out of the aperture 16*b* of the sleeve 16, out of the interior portion 40, and into the cavity 42. In another embodiment, the cutting-bit 14 may be press-fit directly to the aperture 22*a* of the forward mounting portion 22.

The configuration of the cavity 42 extending from the interior portion 40 to the bottom mounting portion 18 may provide a large amount of access to the cavity 42. This may provide additional room for a tool 44 to be inserted into the cavity 42. The tool 44 may be used to remove the cutting-bit 14 and/or sleeve 16 from the aperture 22*a* of the cutting-bit holder block 12. The configuration of the cavity 42 may additionally allow for broken portions of the cutting-bit 14 to be removed from the cavity 42.

Moreover, the skew of the axis 36 through the center of the aperture 22*a* in the forward mounting portion 22 at the angle 38 in a range of 18°-22° relative to the side portion 28 may provide additional access to the cavity 42. This may allow for even more space to remove broken portions of the cutting-bit 14 and to insert the tool 44 to remove the cutting-bit 14 and/or sleeve 16 from the aperture 22*a* of the cutting-bit holder block 12. Additionally, the skew of the axis 36 through the center of the aperture 22*a* in the forward mounting portion 22 at the angle 38 in a range of 18°-22° relative to the side portion 28 may allow for the forward mounting portion 22 to be entirely mounted to the vane 30 of the rotatable cutting drum 32 without any portion of the cutting-bit holder block 12 sticking off the vane 30. This may provide for improved securement of the cutting-bit holder block 12 to the vane 30 of the rotatable cutting drum 32 while maintaining the axis 36 through the center of the aperture 22 in the forward mounting portion 22, and hence the axis of the cutting-bit 14, in the direction of cut as the rotatable cutting drum 32 rotates. Additionally, this configuration may allow for additional room for fluid lines to be disposed in the cutting-bit holder block 12 to direct fluid to the forward mounting portion 22 in order to reduce heat and carry away material of a workpiece cut by the cutting-bit 14.

Figure 5:
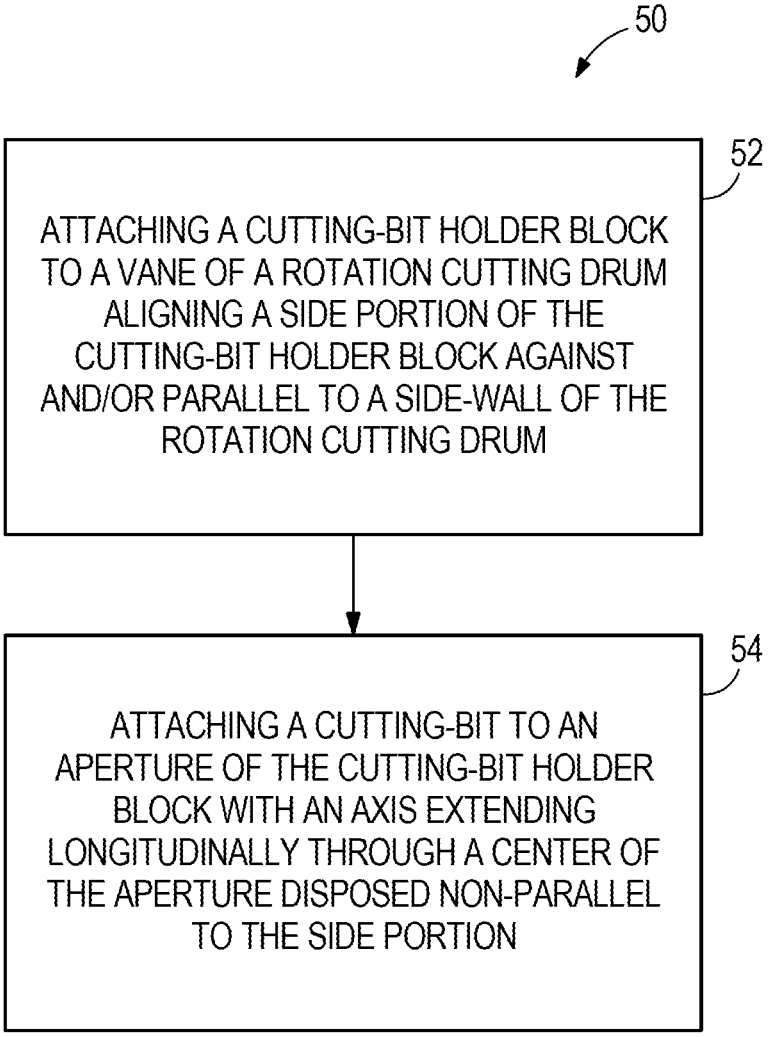
FIG. 5 is a flowchart illustrating one embodiment of a method of use.

FIG. 5 is a flowchart illustrating one embodiment of a method 50 of use. The method 50 may utilize the cutting-bit holder block system 10 of the instant disclosure. In other embodiments, the method 50 may utilize varying cutting-bit holder block systems. In step 52, a cutting-bit holder block may be attached to a vane of a rotatable cutting drum so that a side portion of the cutting-bit holder block is disposed against and/or parallel to a side-wall of the rotatable cutting drum. In step 54, a cutting-bit may be attached to an aperture of the cutting-bit holder block. An axis extending longitudinally through a center of the aperture may be disposed non-parallel to the side portion of the cutting-bit holder block.

In one embodiment of the method 50, an angle extending between the axis and the side portion may be 20°. In another embodiment of the method 50, the angle extending between the axis and the side portion may be in a range of 18°-22°. In still other embodiments, the angle extending between the axis and the side portion may further vary.

In still another embodiment of the method 50, a cavity in communication with the aperture and disposed in the side portion may extend from an interior portion of the cutting-bit holder block to a bottom mounting portion of the cutting-big holder block.

In another embodiment of the method 50, an additional step may comprise removing a broken portion of cutting-bit through a cavity extending from a bottom mounting portion of the cutting-bit holder to an interior portion of the cutting-bit holder block.

In still another embodiment of the method 50, another step may comprise inserting a tool into a cavity, extending from a bottom mounting portion of the cutting-bit holder block to an interior portion of the cutting-bit holder block, and using the tool to remove the cutting-bit and/or a sleeve from the aperture.

In other embodiments, the method 50 may further vary. For instance, one or more steps of the method 50 may not be followed, one or more steps of the method may be varied in substance or order, or one or more additional steps may be added.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

What is claimed is:

1. A cutting-bit holder block comprising:

a forward mounting portion defining an aperture sized to hold a cutting-bit, an axis extending longitudinally through a center of the aperture;

an interior portion within the cutting-bit holder block, the aperture extending from the forward mounting portion to the interior portion;

a bottom mounting portion;

a side portion extending from the forward mounting portion to the bottom mounting portion;

a second side portion extending from the forward mounting portion to the bottom mounting portion, the axis disposed non-parallel to the second side portion, an angle extending between the axis and the second side portion being in a range of 18°-22°; and a cavity disposed in the side portion, the cavity extending from the interior portion to the bottom mounting portion, the cavity in communication with the aperture, the cavity extending from the side portion towards the second side portion without extending through the second side portion.

2. The cutting-bit holder block of claim 1 wherein the side portion comprises a portion of a barrel.

3. The cutting-bit holder block of claim 2 wherein the barrel comprises a radius, a width of the cavity being larger than twice the radius of the barrel.

4. The cutting-bit holder block of claim 1 wherein the side portion comprises a bevel extending to the bottom mounting portion.

5. The cutting-bit holder block of claim 1 further comprising a rearward portion, the cavity disposed between the rearward portion and the interior portion.

6. The cutting-bit holder block of claim 1 wherein the side portion is disposed non-parallel to the axis.

7. The cutting-bit holder block of claim 1 wherein the angle is 20°.

8. The cutting-bit holder block of claim 1 wherein the second side portion comprises a bevel extending to the bottom mounting portion.

9. A method of use comprising:

attaching a bottom mounting portion of a cutting-bit holder block to a vane of a rotatable cutting drum so that a side portion of the cutting-bit holder block is disposed against and/or parallel to a side-wall of the rotatable cutting drum, the side portion extending from a forward mounting portion of the cutting-bit holder block to the bottom mounting portion;

attaching a cutting-bit to an aperture in the forward mounting portion of the cutting-bit holder, wherein an axis extending longitudinally through a center of the aperture is disposed non-parallel to the side portion of the cutting-bit holder block, an angle extending between the axis and the side portion being in a range of 18°-22°; and removing a broken portion of the cutting-bit through a cavity extending from the bottom mounting portion to an interior portion of the cutting-bit holder block, the cavity in communication with the aperture, the cavity disposed in a second side portion of the cutting-bit holder block, the cavity extending from the second side portion towards the side portion without extending through the side portion, the cavity extending from the interior portion to the bottom mounting portion, the aperture extending from the forwarding mounting portion to the interior portion.

10. The method of claim 9 further comprising inserting a tool into the cavity, and using the tool to remove the cutting-bit and/or a sleeve from the aperture.

* * * * *